US006488173B2

(12) United States Patent
Milan

(10) Patent No.: US 6,488,173 B2
(45) **Date of Patent: *Dec. 3, 2002**

(54) BEVERAGE CONTAINER LID HAVING BAFFLE ARRANGEMENT FOR LIQUID COOLING

(76) Inventor: Michael Milan, 29715 Zuma Bay Way, Malibu, CA (US) 90265

( * ) Notice: Subject to any disclaimer, the term of this patent is extended or adjusted under 35 U.S.C. 154(b) by 19 days.

This patent is subject to a terminal disclaimer.

(21) Appl. No.: 09/850,634

(22) Filed: May 7, 2001

(65) Prior Publication Data

US 2002/0003145 A1 Jan. 10, 2002

Related U.S. Application Data

(63) Continuation-in-part of application No. 09/611,074, filed on Jul. 6, 2000, now Pat. No. 6,318,584.

(51) Int. Cl.[7] ..... A47G 19/22

(52) U.S. Cl. ..... 220/713; 215/387; 229/404; 220/711; 220/719; 220/255; 220/374; 220/367.1

(58) Field of Search ..... 215/387; 229/404; 222/547, 564; 220/711, 713, 719, 717, 718, 731, 367.1, 373, 374, 256.1, 255

(56) References Cited

U.S. PATENT DOCUMENTS 3,360,161 A * 12/1967 Smith ..... 220/719
4,322,014 A * 3/1982 Philip ..... 220/713
4,331,255 A * 5/1982 Fournier ..... 220/257.2
4,460,101 A * 7/1984 Tseng ..... 220/719
5,143,248 A * 9/1992 Sawatsky ..... 220/253
5,540,350 A * 7/1996 Lansky ..... 220/713
5,890,619 A * 4/1999 Belanger ..... 220/713
5,979,689 A * 11/1999 Lansky ..... 220/255
6,220,476 B1 * 4/2001 Waller ..... 220/713
6,305,571 B1 * 10/2001 Chu ..... 215/387
6,318,584 B1 * 11/2001 Milan ..... 215/387

* cited by examiner

*Primary Examiner*—Lee Young
*Assistant Examiner*—Robin A Hylton
(74) *Attorney, Agent, or Firm*—Jack C. Munro

(57) ABSTRACT

A removable beverage container lid wherein the lid has a substantially enclosed space defined between an exterior cover and an interior cover. At least one inlet opening is formed in the interior cover directing a hot beverage to flow into the substantially enclosed space. Attached to the interior cover at the forward edge of the inlet opening is a partition or wall assembly having a height extending to be located substantially against the exterior cover and a length at least equal to the length of the inlet opening. Between the partition or wall assembly and the peripheral edge of the exterior cover is located a gap area. Connected with the gap area is a dispensing opening formed in the exterior cover. Hot beverage is required to flow around the partition or wall assembly and into the gap area prior to flowing through the dispensing opening exteriorly of a beverage container.

12 Claims, 2 Drawing Sheets

BEVERAGE CONTAINER LID HAVING BAFFLE ARRANGEMENT FOR LIQUID COOLING

REFERENCE TO PRIOR APPLICATION

This application is a continuation-in-part of U.S. patent application Ser. No. 09/611,074, filed Jul. 6, 2000 by the same title and same inventor.

BACKGROUND OF THE INVENTION

1) Field of the Invention

The subject matter of this invention is directed to a removable lid for a beverage container and more particularly to a lid that is designed to minimize the possibility of burning a user's mouth during consuming a hot beverage and also substantially prevent accidental spillage of the liquid beverage from the beverage container.

2) Description of the Prior Art

It is exceedingly common within the present day society to utilize beverage containers that are made of paper and plastic that are intended to be used once and then disposed. It is also exceedingly common for individuals to utilize these disposable beverage containers to contain hot beverages such as coffee, tea and hot chocolate. It is common that an individual is mobile while consuming of the beverage as the individual may be walking from one location to another, riding in a car or doing some other activity other than merely sitting. It is common to have a lid substantially enclose the open mouth of the beverage container. The primary function of the lid is to prevent leakage of the beverage which can easily occur when the consumer is moving from one location to another or riding in a car. The movement of the car or the movement of the consumer can cause the beverage to move within the beverage container and be squirted out through the dispensing opening formed within the lid. This spilling of the beverage can be deposited on the consumer's hands and clothing or on articles contained near the consumer, such as on a desk.

Another problem associated with lids of the past is that the hot liquid is dispensed directly from the beverage container, through the dispensing opening into the consumer's mouth. Frequently, the hot liquid is at such an elevated temperature that it can actually cause a burn to occur on the lips of the consumer and within the mouth of the consumer. In the past, there has not been made any effort to construct lids to substantially eliminate the possibility of the consumer being burned.

SUMMARY OF THE INVENTION

A first embodiment of beverage container lid which has an exterior cover and an interior cover, both of which are discoid shaped. The peripheral edge of the interior cover is permanently secured to the peripheral edge of the exterior cover. Located between the interior cover and the exterior cover is a substantially enclosed space. The peripheral edge of the exterior cover is to be removably mounted over the mouth of a beverage container with the liquid of the beverage container to be capable of being moved through an inlet opening formed within the interior cover to then be contained within the substantially enclosed space. The inlet opening is non-centrally located within the interior cover with the forward edge of the inlet opening being located substantially closer to the peripheral edge than the rearward edge of the inlet opening. A partition is attached to the interior cover and is located within the substantially enclosed space. The partition has a top edge which is to be located in contact with the interior surface of the exterior cover. The length of the partition is to be at least equal to the length of the inlet opening which requires that the beverage that passes through the inlet opening must pass around the partition to be located within a gap area defined as being part of the substantially enclosed space. A dispensing opening is formed within the exterior cover and is aligned with the gap area. The beverage from the gap area is to be dispensed exteriorly of the beverage container through this dispensing opening by tilting of the beverage container.

A second embodiment of beverage container lid which also has an exterior cover and an interior cover both of which are discoid. The peripheral edge of the interior cover is permanently secured to the peripheral edge of the exterior cover. Located between the interior cover and the exterior cover is a substantially enclosed space. The peripheral edge of the exterior cover is to be removably mounted over the mouth of the beverage container with the liquid of the beverage container to be capable of being moved through a pair of inlet openings formed within the interior cover to then be contained within the substantially enclosed space. The pair of inlet openings are non-centrally located within the interior cover with the forward edge of the inlet openings being located substantially closer to the peripheral edge than the rearward edge of the inlet openings. A wall assembly in the form of a pair of upstanding members is attached to the interior cover with the upstanding members being located between the pair of inlet openings. Each upstanding member has a top edge which is to be located in contact with the interior surface of the exterior cover. The length of the upstanding members is to be at least equal to the length of the inlet openings which requires that the vast majority of the beverage that passes through the inlet openings must pass around the upstanding members to be located within a gap area defined as being part of the substantially enclosed space. A dispensing opening is formed within the exterior cover and is aligned with the gap area. The beverage from the gap area is to be dispensed exteriorly of the beverage container through this dispensing opening by tilting of the beverage container. Each upstanding member abuts against a raised surface formed on the interior surface of the exterior cover. Each of these raised surfaces includes a groove which permits a small quantity of the beverage to be conducted directly from the substantially enclosed space to be deposited within gap area. These grooves provide an initial quantity of beverage into the gap area when the user is taking his or her first drink. The interior cover also includes a weep hole through which the liquid that is contained within the substantially enclosed space can flow back into the beverage container and thereby be reheated if a substantial length of time has occurred from the most recent consumption. Also formed within the interior cover and the exterior cover is a vent.

The primary objective of the present invention is to construct a beverage container lid which substantially eliminates the possibility of spillage of the beverage from the beverage container upon the beverage container encountering a sudden movement.

Another objective of the present invention is to construct a beverage container lid which substantially eliminates the possibility of a hot beverage burning of the consumer's lips or mouth during consuming of the hot beverage.

Another objective of the present invention is to construct a beverage container lid which can be constructed inexpensively and therefor sold to the ultimate consumer at a relatively inexpensive price.

Another objective of the present invention is to a beverage container lid which is simple in construction and therefore non-complex to manufacture.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE PREFERRED EMBODIMENT

Figure 1:
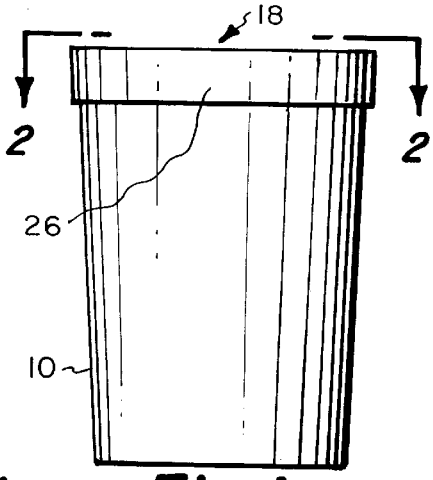
FIG. 1 is an exterior view of a typical beverage container on which has been installed the first embodiment of beverage container lid of the present invention.
Figure 2:
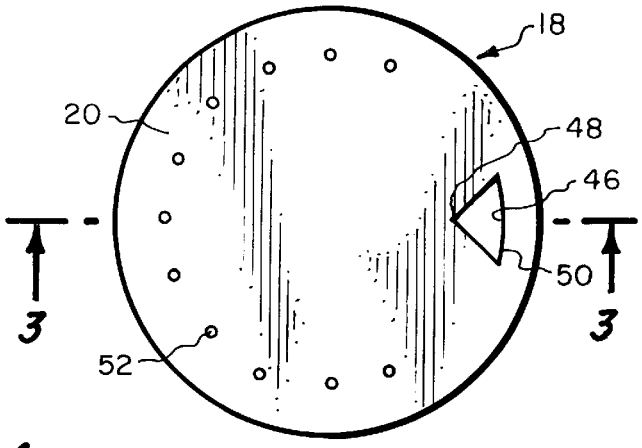
FIG. 2 is a top plan view of the first embodiment of beverage container lid of the present invention taken along line 2—2 of FIG. 1.
Figure 3:
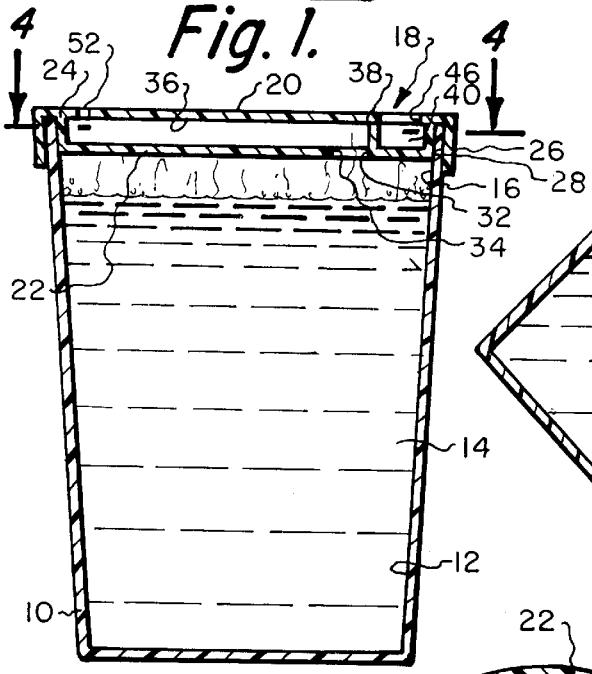
FIG. 3 is a cross-sectional view through the beverage container and the first embodiment of beverage container lid of this invention taken along line 3—3 of FIG. 2 showing the beverage container in a normal resting upright position.

Referring particularly to the drawing, there is shown in FIG. 1 a beverage container 10 that has an internal chamber 12. Within the internal chamber 12 there is to be located a quantity of a beverage 14. The beverage container 10 has an open mouth 16. A typical beverage could be a cold beverage or a hot beverage. However, the structure of the present invention is designed in particular to be used in conjunction with a hot beverage such as tea, coffee or hot chocolate.

The open mouth 16 is to be closeable by a first embodiment of lid 18. The lid 18 is to be constructed of plastic or other similar type of sheet material such as a paper composition. The lid 18 has an exterior cover 20 and an interior cover 22. Both the exterior cover 20 and the interior cover 22 are of a discoid shape and are both substantially planar.

However, it is to be within the scope of this invention that the covers 20 and 22 could be other than a discoid shape, such as for an example a square shape or another polygonal shape such as hexagonal or octagonal. Typically, the thickness of the covers 20 and 22 will generally by about one-eighth of an inch.

The interior cover 22 has a peripheral edge which is formed into an annular flange 24. The upper edge of the annular flange 24 is glued or otherwise fixedly secured, as by heat sealing, to the inside surface of the exterior cover 20.

Integrally connected to the peripheral edge of the exterior cover 20 is an annular depending flange 26. In between the depending flange 26 and the annular flange 24 is located an annular groove 28. The upper edge of the beverage container 10 located at the open mouth 16 is to be snugly located within the annular groove 28. This will fixedly secure the lid 18 onto the beverage container 10. However, the lid 18 can be manually disengaged from the beverage container 10 by merely pulling of the lid 18 away from the beverage container 10.

Figure 5:
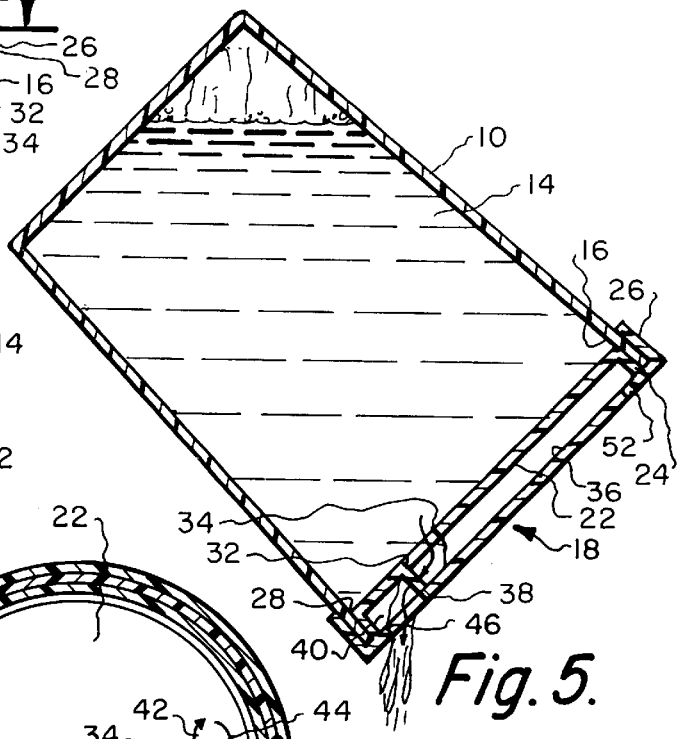
FIG. 5 is a view similar to FIG. 3 but showing the beverage container in the typical tilted position for consuming of the beverage contained within the beverage container.

The interior cover 22 includes an inlet opening 30. The inlet opening 30 is generally no more than three quarters of an inch to one inch in length and about one quarter of an inch wide. The inlet opening 30 is located in an off center position within the interior cover 22. The inlet opening 30 has a forward edge 32 and a rearward edge 34. Upon tilting of the beverage container 10 to a tilted position, such as depicted within FIG. 5, a small quantity of the beverage 14 is to flow through the inlet opening 30 to within the substantially enclosed space 36 formed between the exterior cover 20 and the interior cover 22.

Fixedly mounted onto the upper surface of the interior cover 22 at the forward edge 32 is a partition 38. The partition 38 has a top edge that is to be in contact with the interior surface of the exterior cover 20. The partition 38 comprises an arcuately shaped wall that is about three quarters to an inch long with it be important that the partition 38 be at least as long as the length of the inlet opening 30. Actually, the partition 38 comprises the "punched out" material of interior cover 12 that forms inlet opening 30. In between the partition 38 and the annular flange 24 is a gap area 40. It is to be noted that the gap area 40 is generally no more than a quarter to a half inch wide. This means the partition 38 is located very near the annular flange 24 with there being a substantial amount of space from the rearward edge 34 to the annular flange 24. The reason for this is so that when the beverage container 10 is tilted is that the beverage 14 will flow through the inlet opening 30, depicted by arrows 42, to against the partition 38 and then around the partition 38 is shown by arrows 44 to within the gap area 40.

Connecting with the gap area 40 is a dispensing opening 46, which is shown to be of a triangular configuration. The consumer is to locate his or her mouth about the dispensing opening 46 with the upper lip being located in the area of the point 48 and the bottom lip located close to but spaced from the base 50. The point 48 prevents the beverage, if hot, from contacting to any great extent the upper lip of the consumer. This is so as to protect the upper lip against burning. Although the fact that the beverage has to travel some distance, that is from the inlet opening 30, around the partition 38, to within the gap area 40 prior to being dispensed through the dispensing opening 46. This distance of travel should be sufficient enough to substantially cool the beverage and prevent burning of any portion of the consumer's mouth. Also, the vent holes 52 help to cool the beverage by letting "steam" escape into the ambient.

If the beverage container 10 is jostled or inadvertently tipped over, the fact that the beverage 14 must be conducted through the inlet opening 30 and then through the dispensing opening 46 substantially minimizes the possibility of any accidental dispensing of the beverage 14. The vent holes 52 are so small that a minimal amount of beverage could flow through these holes 52 into the ambient if the beverage container 10 is tipped over. The purpose of this is to prevent contamination of the consumer's workplace as well as the consumer's clothes and contact with the consumer's person.

Figure 4:
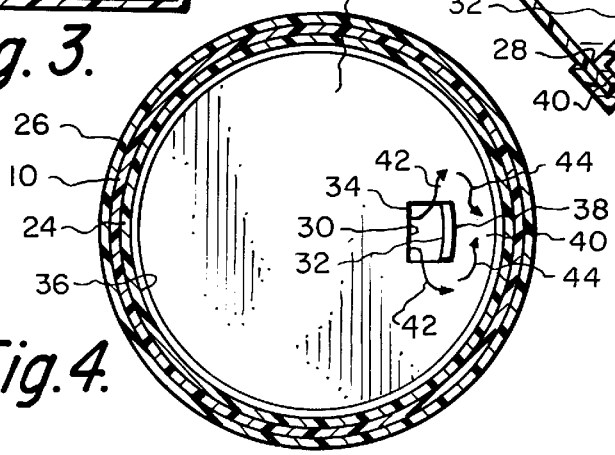
FIG. 4 is a view partly in cross-section through the first embodiment of beverage container lid of the present invention taken along line 4—4 of FIG. 3.
Figure 6:
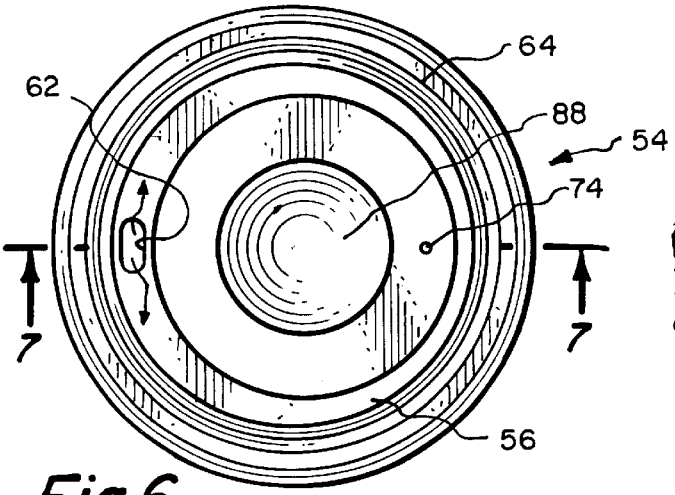
FIG. 6 is a top plan view of a second embodiment of beverage container lid of the present invention.
Figure 9:
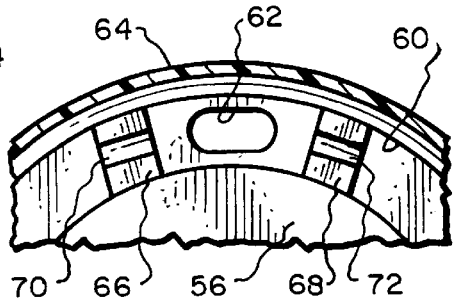
FIG. 9 is a view partly in cross-section of the interior surface of the exterior cover of the second embodiment of beverage container lid of the present invention taken along line 9—9 of FIG. 8.
Figure 7:
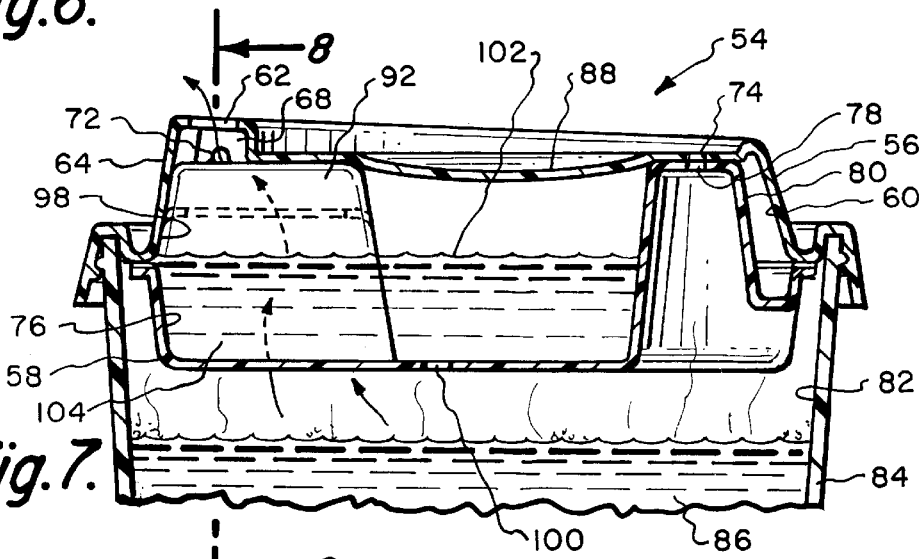
FIG. 7 is a transverse cross-sectional view through the second embodiment of beverage container lid of the present invention taken along line 7—7 of FIG. 6.
Figure 8:
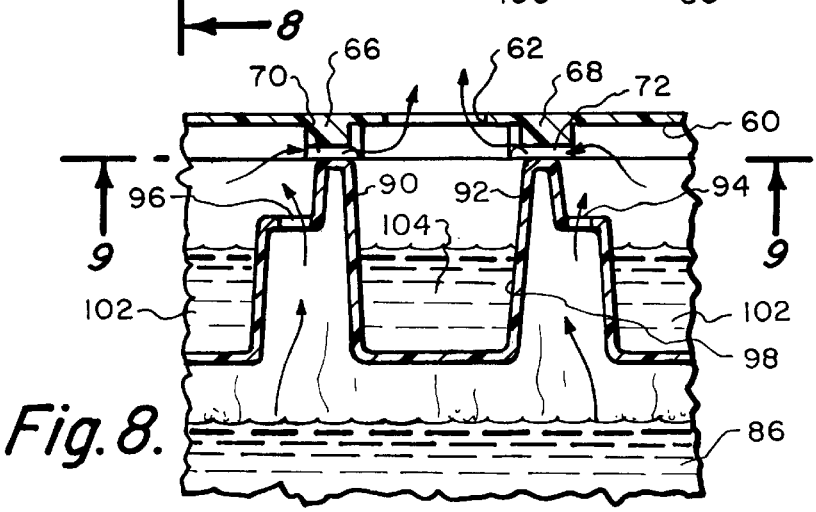
FIG. 8 is a transverse cross-sectional view through the second embodiment of beverage container lid of the present invention taken along line 8—8 of FIG. 7 showing in more detail the flow of the beverage through the dispensing opening.

Although the partition 38 is shown to be of an arcuate configuration which is believed to help in directing the beverage 42 in the direction of arrows 42, it is considered to be within the scope of this invention that the partition 38 could be of another configuration, such as a straight configuration or possibly even a convex configuration rather than concave shown in FIG. 4.

Referring particularly to FIGS. 6–9 of the drawings, there is shown the second embodiment 54 of lid of this invention. The second embodiment 54 includes an exterior cover 56 and an interior cover 58. Both the exterior cover 56 and interior cover 58 are discoid shape. However, it is considered to be within the scope of this invention that the covers 56 and 58 could be other than a discoid shape. Again, the thickness of the covers 56 and 58 will generally be about one-eighth of an inch.

The exterior cover 56 has an inner surface that defines an internal chamber 60. Formed within the exterior cover 56 is a dispensing opening 62. The dispensing opening 62 is positioned directly adjacent the peripheral edge 64 of the exterior cover 56. Formed integral with the exterior cover 56 and located within the internal chamber 60 and positioned just on one side of the dispensing opening 62 is a raised surface 66 with a similar raised surface 68 being located on the opposite side of the dispensing opening 62. The raised surface 66 includes a through groove 70 with a similar through groove 72 being formed within the raised surface 68. The purposes of the through grooves 70 and 72 will be explained further on in the specification. The exterior cover 56 also includes a vent hole 74. The vent hole 74 may directly connect with the substantially enclosed space 76 of the interior cover 58 or may connect directly with a hole 78 formed within a post 80 which is formed integral with the interior cover 58. The post 80 is to cause the venting of steam to occur directly from the internal chamber 82 of the beverage container 84. Hot liquids 86, such as coffee or tea, are to be contained within the internal chamber 82.

The exterior cover 56 includes a centrally located indentation 88. This indentation 88 is for the purpose of giving strength to the overall construction of the exterior cover 56.

The interior cover 58 also includes a partition in the form of a pair of spaced apart upstanding walls 90 and 92. Outside of the upstanding wall 92 is located a hole 94. Outside of the upstanding wall 90 is a hole 96. In between the walls 90 and 92 is located a gap area 98. When the interior cover is secured, as by adhesive or sonic welding to exterior cover 56, the upper surface of the upstanding wall 90 is to rest against the raised surface 66 and the upper surface of the upstanding wall 92 is to rest against the raised surface 68.

When the beverage container is first tilted and the first drink is to be consumed from the beverage container, there should be no beverage contained within the substantially enclosed space 76. Also, if it had been some time since the last drink, the beverage 102 that would have been contained within the substantially enclosed space 76 would have leaked back through weep hole 100 into the internal chamber 82 to be intermixed with and reheated by hot beverage 86. However, when the first drink is being consumed, there will normally be no liquid contained within the substantially enclosed space 76 as it will take some time (a few seconds) for the beverage to pass through the holes 94 and 96 to fill the substantially enclosed space 76 and then flow around the upstanding walls 90 and 92 to fill the gap area 98. To avoid this few seconds of filling at the time the first drink is taken, the beverage is permitted to flow through the through grooves 70 and 72 directly into the gap area 98. This initial direct flow of the beverage will then provide an immediate small quantity 104 of the beverage to the user to be consumed. This flowing through the through grooves 70 and 72 will cause a drop in temperature of the beverage so that the beverage is cooled somewhat so as to not be too hot when initially consumed. After the first drink has occurred, there will be contained a quantity 102 of the beverage within the substantially enclosed space 76. When the user takes another drink, the quantity 102 will then merely flow around the upstanding walls 90 and 92 and fill the gap area 98 with a small quantity 104. The time that it takes for the beverage to flow into the substantially enclosed space 76 and then around the upstanding walls 90 and 92 into the gap area 98 will result in the quantity 104 to be at a lesser temperature than the quantity 102 of the beverage or the beverage 86 so that the quantity 104 that is being directly consumed will not cause a burning of the consumer's mouth.

The present invention may be embodied in other specific forms without departing from the essential attributes thereof. Reference should be made to the appending claims rather than the foregoing specification as indicating the scope of the invention.

What is claimed is:

1. A beverage container lid comprising:

an exterior cover and an interior cover, said interior cover having a peripheral edge which is secured to said exterior cover forming a substantially enclosed space between said interior cover and said exterior cover, said lid adapted to be installed over an open mouth of a beverage container which contains a beverage;

an inlet opening formed within said interior cover, said inlet opening being non-centrally located within said interior cover, said inlet opening adapted to permit flow of the beverage from the beverage container into said substantially enclosed space;

a partition attached to said interior cover and extending to contact said exterior cover, whereby the beverage that flows through said inlet opening flows into said substantially enclosed space and into a gap area which is part of said substantially enclosed space; and a dispensing opening formed within said exterior cover, said dispensing opening adapted for dispensing of the beverage from the beverage container, said dispensing opening being aligned with said gap area, whereby upon tilting of the beverage container, the liquid beverage must flow through said inlet opening and around said partition and then through said dispensing opening which will function to cool the beverage if such is a hot beverage.

2. The beverage container lid as defined in claim 1 wherein:

said inlet opening having a length, said partition being at least as long as said length so that all of the beverage that flows through said inlet opening must flow around said partition and not directly from said inlet opening into said gap area.

3. The beverage container lid as defined in claim 1 wherein:

said inlet opening being located directly adjacent said dispensing opening.

4. The beverage container lid as defined in claim 1 wherein:

said dispensing opening being triangularly shaped having a base, said base being located in substantial alignment with said peripheral edge, whereby an angle of the triangularly shaped dispensing opening will be located at an upper lip area of the user which is to minimize contact of a hot beverage with the upper lip area.

5. The beverage container lid as defined in claim 1 wherein:

said partition having a top edge which is to be located in contact with said exterior cover, said partition being arcuately shaped when observed at said top edge.

6. The beverage container as defined in claim 1 wherein:

said exterior cover having at least one vent opening for releasing of steam from the beverage contained within said enclosed space.

7. A beverage container lid comprising:

an exterior cover and an interior cover, said interior cover having a peripheral edge which is secured to said exterior cover forming a substantially enclosed space between said interior cover and said exterior cover, said lid adapted to be installed over an open mouth of a beverage container which contains a beverage;

an inlet opening assembly formed within said interior cover, said inlet opening assembly adapted to permit flow of the beverage from the beverage container into said substantially enclosed space;

a wall assembly located within said substantially enclosed space extending between said interior cover and said exterior cover, whereby the beverage that flows through said inlet opening assembly flows into said substantially enclosed space and into a gap area which is part of said substantially enclosed space; and a dispensing opening formed within said exterior cover, said dispensing opening adapted for dispensing of the beverage from the beverage container, said dispensing opening being aligned with said gap area, whereby when tilting the beverage container, most of the beverage must flow through said inlet opening assembly and around said wall assembly and through said dispensing opening which will function to cool the beverage if such is a hot beverage.

8. The beverage container lid as defined in claim 7 wherein:

said inlet opening assembly comprising a pair of spaced apart inlet openings with said gap area being located between said inlet openings.

9. The beverage container lid as defined in claim 7 wherein:

said wall assembly being integrally connected to said interior cover.

10. The beverage container lid as defined in claim 7 wherein:

said exterior cover having an interior surface which defines an interior chamber, said interior surface has a pair of spaced apart raised areas, a said raised area to connect directly to a portion of a wall assembly, each said raised area including a through groove, each said through groove adapted to permit a small amount of the beverage to be conducted from the substantially enclosed space to be confined within said gap area.

11. The beverage container lid as defined in claim 7 wherein:

said wall assembly comprising a pair of upstanding members located spaced apart, said upstanding members being located between said inlet openings.

12. A beverage container lid as defined in claim 7 wherein:

said exterior cover including a vent opening, said vent opening engages with a hole formed within said interior cover, said hole being mounted within a post integrally formed with said interior cover, whereby said vent opening functions to release steam from the beverage that is contained within said beverage container.

* * * * *